United States Patent [19]

Giesecke

[11] Patent Number: 4,568,570

[45] Date of Patent: Feb. 4, 1986

[54] PROCESS FOR ACTIVATING SUBSTRATES FOR ELECTROLESS METALLIZATION

[75] Inventor: Henning Giesecke, Cologne, Fed. Rep. of Germany

[73] Assignee: Bayer Aktiengesellschaft, Leverkusen, Fed. Rep. of Germany

[21] Appl. No.: 661,007

[22] Filed: Oct. 15, 1984

[30] Foreign Application Priority Data

Oct. 18, 1983 [DE] Fed. Rep. of Germany ..... 3337856

[51] Int. Cl.[4] ..... B05D 3/04; B05D 3/10

[52] U.S. Cl. ..... 427/304; 427/305; 427/306

[58] Field of Search ..... 427/304, 305, 306

[56] References Cited

U.S. PATENT DOCUMENTS

| | | | |
|---|---|---|---|
| 3,880,580 | 4/1975 | Horowitz et al. | 427/304 X |
| 4,248,632 | 2/1981 | Chrich et al. | 427/304 X |
| 4,362,779 | 12/1982 | Arsac | 427/304 X |

*Primary Examiner*—James R. Hoffman

*Attorney, Agent, or Firm*—Sprung, Horn, Kramer & Woods

[57] ABSTRACT

A gentle and inexpensive process for activating surfaces for electroless metallization comprises wetting the surfaces with an activating solution containing a silver-I compound which is sparingly soluble in water (for example AgCl) and which has been converted into a soluble form with the aid of complexing agents (for example $NH_3$), splitting the soluble complex compound back into the sparingly soluble compound and reducing the silver-I compound remaining on the surface.

11 Claims, No Drawings

PROCESS FOR ACTIVATING SUBSTRATES FOR ELECTROLESS METALLIZATION

The invention relates to a gentle process for activating non-conductive or semi-conductive substrate surfaces for electrochemical deposition of metal.

It is generally known that metallisation of surfaces of this type requires a relatively expensive pretreatment. This includes, for example, roughening of the surface by mechanical action or etching with powerful oxidising agents, impregnation with ionic or colloidal noble metal solutions, reduction of the noble metal ions to the metal and several rinsing operations.

The technological disadvantages of these multistage measures, some of which are very drastic, are evident.

Various activation processes which are technologically simpler to carry out and are gentle on the material have therefore been proposed, especially in the patent literature, in which the substrates to be metallised are treated with solutions or dispersions of complex compounds of elements of sub-groups 1 and 8 of the periodic table in solvents, which are usually organic (compare German Pat. Nos. A 1,696,603, A 2,451,217, A 2,116,389, A 3,025,307, A 3,148,280 and many others).

However, these processes, which are very elegant per se, also have not been able to be completely satisfactory.

Apart from the fact that optimum activation effects can be achieved virtually only with the compounds of relatively expensive palladium, these processes also have, in particular, various disadvantages which have a greater or lesser degree of seriousness from case to case.

Besides the sometimes low storage stability of the activating baths and the sometimes inadequate adhesion of the activators on the substrate surface, the volatility, combustibility and toxicity of the organic solvents and, in particular, the high cost of the metal complex compounds should be mentioned.

In the activation processes using noble metal complexes from aqueous solution which have hitherto been described, the adhesion of the noble metal seeds onto the substrate surfaces is so low that a number of rinsing operations are required in order to prevent noble metal seeds from being entrained into the metallisation baths.

The object of the present invention was thus to avoid these disadvantages as far as possible, that is to say to develop a more inexpensive activation process which effects good adhesion of the activators onto the surfaces to be metallised in a simple manner, which also as far as possible dispenses with organic solvents.

According to the invention, such a "seeding" is now achieved by a process in which (a) the surface to be metallised is wetted with an activating solution containing a silver-I compound which is sparingly soluble in water and has been converted into a soluble form with the aid of complexing agents,
(b) the soluble complex compound is split back into the sparingly soluble silver-I compound and
(c) the silver-I compound remaining on the surface of the substrate is reduced.

The advantages of this process compared with the activation methods hitherto known are obvious:

1. Instead of the expensive palladium, the substantially cheaper silver is used as the activator.

2. The process is preferably carried out in an aqueous medium—that is to say in the absence of organic solvents.

3. The detachment of the silver metal seeds from the substrate surface is so low that the customary rinsing operations can be dispensed with and, in a particular embodiment of the process, the reduction of the silver compound can therefore even be carried out in an electroless metallisation bath without poisoning of the metallisation bath having to be feared.

Preferred complexing agents for dissolving the sparingly soluble silver compounds are nitrogen-containing compounds which, under the action of heat and/or acids, give complexes which can easily be split. Aqueous ammonia is particularly preferred. Moreover, it is also possible to use amines, but their boiling point should preferably be below 100° C. In principle, other complexing agents can also be used, such as, for example, cyanide ions or thiosulphate ions.

As already mentioned, the seeding is preferably carried out from aqueous solution. Water-like compounds, such as, for example, aliphatic alcohols or mixtures of organic solvents with water or alcohols, can, of course, also be used. For substrates of which the surfaces are hardly wetted or wetted only very poorly by the activating solutions, it may be necessary to add wetting agents, such as, for example, Mersolate or Texapon, to the solutions.

The concentration of silver compounds is in general between 0.01 g and 10 g/liter, and in particular cases also above or below these limits. Examples of preferred silver-I compounds are silver chloride, silver bromide, silver cyanide, silver isothiocyanate, silver chromate, silver nitrite, silver metaphosphate and silver diphosphate.

The process according to the invention is advantageously carried out as follows:

The surfaces of the substrates to be metallised are wetted with the complex solutions, the action time preferably being 1 second to 1 minute. Processes such as immersion of the substrate into the solutions or spraying or brushing of the substrate surfaces are particularly suitable for this purpose. It is furthermore also possible to apply the activating solutions by stamping and/or printing processes.

The wetting is carried out at temperatures between 0° C. and 90° C. In particular cases, the temperature can also be below or above these limits. The wetting is very particularly preferably carried out at 15°–40° C.

After the wetting, the organic solvent employed is removed, if appropriate, and the complexes applied are split. This is preferably effected by the action of heat, it being necessary to choose the temperature and drying conditions such that the surfaces of the substrates are not attacked. In general, temperatures of 0° to 200° C., preferably 50° to 150° C., are used here; in particular cases (freeze-drying, stoving) the temperatures can also be below or above these values.

Another variant of the process comprises precipitating the sparingly soluble silver salt on the moistened surface by a chemical reaction. Acidification of a silver amine chloride solution with mineral acid, which leads to precipitation of silver chloride, may be mentioned as an example. In these cases, it is no longer necessary to remove the complexing agent.

The surfaces seeded by one of the process variants described must then be activated by reduction. The reducing agents customary in electroplating, such as hydrazine hydrate, formaldehyde, hypophosphite, boranes or borohydrides, can preferably be used for this purpose. The reduction is preferably carried out in aqueous solution. However, other solvents, such as alcohols, ethers or hydrocarbons, can also be used.

Suitable substrates for the process according to the invention are: glass, quartz, ceramics, carbon, paper, polyethylene, polypropylene, ABS plastics, epoxy resins, polyesters, polycarbonates, polyamides, polyethylene fluoride and textile sheet-like structures, filaments and fibres of polyamide, polyester, polyalkylene, polyacrylonitrile, polyvinyl halides, cotton and wool and mixtures thereof or copolymers, graphite fibres, flock and whiskers of aluminium oxide and many others. Textile materials are preferred.

The surfaces activated according to the invention can in most cases be employed directly for electroless metallisation.

A very particularly preferred embodiment of the process according to the invention comprises carrying out the reduction in the metallisation bath immediately with the reducing agent of the electroless metallisation. This variant consists of only the three operations, for example: immersion of the substrate into the solution of the silver compound, drying of the substrate surfaces and immersion of the surfaces thus activated into the metallisation bath.

This embodiment is especially suitable for nickel baths containing aminoborane or copper baths containing formalin.

Metallisation baths which can be used in the process according to the invention are preferably baths with nickel salts, cobalt salts, copper salts or mixtures thereof with iron salts, gold salts and silver salts. Such metallisation baths are known in the art of electroless metallisation.

It is surprising that, even in alkaline metallisation baths containing ammonia, the silver salts according to the invention are only detached from the seeded substrate surfaces to such a low degree that metallisation of the surfaces takes place without destruction of the metallisation baths by noble metal seeds.

EXAMPLES

Example 1

A 15 cm×15 cm square of a cotton fabric (satin) is immersed in a solution of 0.7 g of silver chloride in one liter of aqueous ammonia for 10 seconds, subsequently dried at 90° C. and then nickeled for 10 minutes in an alkaline nickeling bath which contains 30 g/liter of nickel chloride, 10 g/liter of dimethylaminoborane and 10 g/liter of citric acid and has been brought to pH 8 with ammonia. A piece of material with a metallic gloss and a metal deposit of 44 g of nickel/m$^2$ is obtained. The electrical resistance of a 10 cm×10 cm square area is 2 Ohm in the warp direction and 3 Ohm in the weft direction.

Example 2

A 15 cm×15 cm square of a polyamide fabric (polyamide 6) is immersed in a solution of 1.3 g of silver chloride in one liter of aqueous ammonia for 1 minute. The fabric is then dried at 80° C. and subsequently nickeled for 30 minutes in an alkaline nickeling bath according to Example 1. A piece of material with a metallic gloss and a metal deposit of 37 g of nickel/m$^2$ is obtained. The resistance, measured on a 10 cm×10 cm square area, is 0.2 Ohm in the warp direction and 0.4 Ohm in the weft direction.

Example 3

A 15 cm×15 cm square of a carbon fabric (linen) is immersed for 1 minute in an activating solution containing 0.5 g of silver chloride/liter of aqueous ammonia. The fabric is dried at 120° C. and is then metallised for 1 hour in an alkaline nickeling bath according to Example 1. A fabric with a metallic gloss and a metal deposit of 55 g of nickel/m$^2$ is obtained. The resistance of a 10 cm×10 cm square area is 0.2 Ohm in the warp direction and 0.3 Ohm in the weft direction.

Example 4

A 15 cm×15 cm net of aromatic polyamide is immersed for 30 seconds in an activating solution containing 7 g/liter of an ammoniacal aqueous solution of silver chloride. The fabric is then dried at 100° C. After metallising in an alkaline nickeling bath according to Example 1 for 10 minutes, a net with a metallic gloss and a metal deposit of 10 g/m$^2$ is obtained. The resistance of a 10 cm×10 cm square area is 16 Ohm and 18 Ohm.

Example 5

A knitted fabric of a polyester fibre yarn (Nm 40) (100% polyethylene terephthalate) is immersed at room temperature for 1 minute in an activating solution according to Example 4. The knitted fabric is dried at 100° C. and then nickeled for 45 minutes in an alkaline nickeling bath according to Example 1. A knitted fabric with a metallic gloss and a metal deposit of 76 g of nickel/m$^2$ is obtained.

Example 6

A glass plate 20 cm×8 cm is uniformly sprayed with an activating solution according to Example 4, dried and then metallised for 5 minutes in an alkaline nickeling bath according to Example 1. After 1 minute, the surface becomes dark-coloured, and a layer with a metallic gloss is observed after 5 minutes. The sheet of glass washed and dried after the metallisation is coated with a reflecting layer of metal.

Example 7

A 30 cm×8 cm polyester film is degreased with 20% strength sodium hydroxide solution at 70° C. (10 minutes) and then sprayed on one side with an activating solution containing 3.5 g of silver chloride/liter of ammoniacal water. The film is dried at 120° C. and then immersed for 2 minutes in a solution of 1 g of sodium borohydride in one liter of water. The film is then rinsed with water and subsequently metallised at 70° C. in an alkaline cobalt bath containing 35 g/liter of cobalt sulphate, 140 g/liter of potassium sodium tartrate and 20 g/liter of sodium hypophosphite. A film which is cobalted on one side and has a cobalt content of 8.3 g/m$^2$ is obtained.

Example 8

A cotton fabric according to Example 1 is immersed for 30 seconds in an activating solution containing 1.5 g of silver thiocyanate/liter of aqueous ammonia. The sample is dried at 120° C. and then nickeled for 40 minutes in an alkaline nickel bath according to Example 1. A piece of material with a metallic gloss and a nickel deposit of 88 g/m$^2$ is obtained.

Example 9

A polyamide fabric according to Example 2 is immersed for 1 minute in a solution of 1 g of silver bromide in one liter of aqueous ammonia, subsequently dried at 80° C. and then nickeled for 80 minutes in an alkaline nickeling bath according to Example 1. A piece of material with a metallic gloss and a nickel deposit of 60 g/m$^2$ is obtained. The resistance of a 10 cm×10 cm area is 0.1 Ohm in the warp direction and 0.2 Ohm in the weft direction.

Example 10

A 15 cm×15 cm piece of paper is immersed in an activating solution according to Example 1, dried according to Example 1 and then reduced in 2% strength aqueous dimethylaminoborane solution. After rinsing with water, the activated piece of paper is nickeled for 25 minutes at room temperature in an alkaline nickeling bath which contains 30 g/liter of nickel chloride, 20 g/liter of citric acid and 8 g/liter of sodium hypophosphite and has been brought to pH 9 with ammonia. A piece of paper with a metallic gloss and a metal deposit of 41 g/m$^2$ is obtained. The resistance of a 10 cm× 10 cm square area is 2 Ohm in both directions.

Example 11

A 15 cm×15 cm square of a cotton fabric (satin) is immersed for 30 seconds in a solution of 1.6 g of silver chloride in one liter of aqueous ammonia. The piece of material is then immersed for one minute in 3% strength hydrochloric acid solution, washed and subsequently nickeled for 15 minutes in an alkaline nickeling bath according to Example 1. A piece of material with a metallic gloss and a nickel deposit of 48 g/m$^2$ is obtained. The electrical resistance of a 10 cm×10 cm square area is 0.9 Ohm in the warp direction and 1.3 Ohm in the weft direction.

Example 12

A piece of ABS pre-etched with chromic acid is immersed in a solution of 3 g of silver chloride in one liter of aqueous ammonia, subsequently dried at 80° C. and then metallised for 10 minutes in an alkaline nickeling bath according to Example 1. After 30 seconds, the surface begins to become dark-coloured, and a firmly adhering layer of nickel with a metallic gloss has been deposited after 10 minutes.

Example 13

A 15 cm×15 cm piece of polyamide 6 fabric is immersed for one minute in an ammoniacal aqueous solution of 2.5 g of silver chloride/liter, subsequently dried at 130° C. and then introduced into an alkaline copper bath of 10 g/liter of copper sulphate, 14 g/liter of sodium potassium tartrate and 20 ml/liter of 35% strength by weight formaldehyde solution, which has been brought to pH 12.5 to 13 with sodium hydroxide solution. After one minute, the surface of the fabric begins to become dark-coloured, and a copper-coloured fabric with a metallic gloss and containing 12 g/m$^2$ of copper is obtained after 20 minutes. The resistance of a 10 cm×10 cm square area is 3.5 Ohm in the warp direction and 5 Ohm in the weft direction.

I claim:

1. Process for activating non-conductive or semiconductive substrate surfaces for the purpose of electroless metallisation, characterised in that (a) the surface to be metallised is wetted with an activating solution containing a silver-I compound which is sparingly soluble in water and has been converted into a soluble form with the aid of complexing agents, (b) the soluble complex compound is split back into the sparingly soluble silver-I compound and (c) the silver-I compound remaining on the surface of the substrate is reduced.

2. Process according to claim 1, characterised in that silver chloride, silver bromide, silver cyanide, silver isothiocyanate, silver chromate, silver nitrite, silver metaphosphate or silver diphosphate is used as the silver-I compound.

3. Process according to claim 1, characterised in that ammonia or amines with a boiling point below 100° C. are used as complexing agents.

4. Process according to claim 1, characterised in that the concentration of the silver complex solution is 0.01 to 10%.

5. Process according to claim 1, characterised in that activating solutions which are free from organic solvents are used.

6. Process according to claim 1, characterised in that the soluble silver complexes are split back by drying.

7. Process according to claim 1, characterised in that the silver complexes are split back by heating to 50°-150° C.

8. Process according to claim 1, characterised in that the soluble silver complexes are split back by the action of mineral acids.

9. Process according to claim 1, characterised in that the silver compound which has been split back is reduced in the metallisation bath.

10. Process according to claim 9 characterized in that the silver compound which has been split back is reduced in a nickel metallisation bath containing aminoborane.

11. Process according to claim 9 characterized in that the silver compound which has been split back is reduced in a copper metallisation bath containing formalin.

* * * * *